US005427131A

United States Patent [19]

Eggers, Jr.

[11] Patent Number: 5,427,131

[45] Date of Patent: Jun. 27, 1995

[54] CRUTCHES WITH SHIFTABLE CRADLES

[76] Inventor: Jack L. Eggers, Jr., P.O. Box 15, Pimento, Ind. 47866

[21] Appl. No.: 329,288

[22] Filed: Oct. 26, 1994

[51] Int. Cl.[6] ..... A61H 3/02

[52] U.S. Cl. ..... 135/68; 135/73

[58] Field of Search ..... 135/68, 73, 84, 66, 135/65

[56] References Cited

U.S. PATENT DOCUMENTS

| | | | |
|---|---|---|---|
| 254,348 | 2/1882 | Maine | 135/73 X |
| D. 268,456 | 4/1983 | Oleniak et al. | D3/10 |
| D. 318,366 | 7/1991 | Goldstein et al. | D3/10 |
| 1,266,074 | 5/1918 | Sparrow | 135/73 |
| 1,318,505 | 10/1919 | Rabczynski | 135/73 |
| 1,332,642 | 3/1920 | Tarbell | 135/73 |
| 2,547,265 | 4/1951 | Hilgeman | 135/73 |
| 3,537,463 | 11/1970 | Smith et al. . | |
| 5,101,846 | 4/1992 | Greatwood . | |
| 5,201,334 | 4/1993 | Tseng . | |

*Primary Examiner*—Lanna Mai

[57] ABSTRACT

Crutches with shiftable cradles including a lower rod positioned in a vertical orientation with an upper end and a lower end and a pair of radial apertures extending through the lower rod adjacent to its upper end; a pair of upper rods each with the rods being parallel with respect to each other from their upper ends to an area adjacent their lower ends with axial apertures therethrough with bolts and associated nuts extending through the apertures for the coupling thereof; a lower cradle formed with an upper surface and a lower surface and in a curved configuration the lower cradle having a lower surface coupled with respect to the upper ends of the upper bars and having an upper surface with a recess extending upwardly therefrom; an upper cradle having an upper surface and a lower surface in a curved configuration essentially concentric with the lower cradle, the central extent of the lower cradle coupled to the upper edge of the connector; and coupling components interconnecting the upper and lower cradles.

3 Claims, 4 Drawing Sheets

CRUTCHES WITH SHIFTABLE CRADLES

BACKGROUND OF THE INVENTION

1. Field of the Invention

The present invention relates to crutches with shiftable cradles and more particularly pertains to maximizing the comfort of people utilizing crutches by having the cradles shift forwardly and rearwardly for changing the area of the body receiving the maximum forces from the crutches.

2. Description of the Prior Art

The use of crutches of a wide variety of designs and configurations is known in the prior art. More specifically, crutches of a wide variety of designs and configurations heretofore devised and utilized for the purpose of minimizing the discomfort created through the use of crutches through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 3,537,463 discloses a crutch.

U.S. Pat. No. 5,101,846 discloses a covered crutch pad.

U.S. Pat. No. 5,201,334 discloses a crutch.

U.S. Pat. No. Des. 268,456 discloses the design of a crutch pad.

U.S. Pat. No. Des. 318,366 discloses the design of an arm cushion for a crutch.

In this respect, the crutches with shiftable cradles according to the present invention substantially depart from the conventional concepts and designs of the prior art, and in doing so provide an apparatus primarily developed for the purpose of maximizing the comfort of people utilizing crutches by having the cradles shift forwardly and rearwardly for changing the area of the body receiving the maximum forces from the crutches.

Therefore, it can be appreciated that there exists a continuing need for new and improved crutches with shiftable cradles which can be used to maximize the comfort of people utilizing crutches by having the cradles shift forwardly and rearwardly for changing the area of the body receiving the maximum forces from the crutches. In this regard, the present invention substantially fulfills this need.

SUMMARY OF THE INVENTION

In view of the foregoing disadvantages inherent in the known types of crutches of a wide variety of designs and configurations now present in the prior art, the present invention provides improved crutches with shiftable cradles. As such, the general purpose of the present invention, which will be described subsequently in greater detail, is to provide new and improved crutches with shiftable cradles and method which has all the advantages of the prior art and none of the disadvantages.

To attain this, the present invention essentially comprises new and improved crutches with shiftable cradles comprising, in combination, a lower rod positioned in a vertical orientation with an upper end and a lower end and an elastomeric cover over the lower end and a pair of radial apertures extending through the lower rod adjacent to its upper end; a pair of upper rods each having upper ends and lower ends, with the rods being parallel with respect to each other from their upper ends to an area adjacent their lower ends and with the lower ends being angled inwardly and formed with axial apertures therethrough with bolts and associated nuts extending through the apertures for the coupling thereof, the upper rods having a lateral support extending in a horizontal orientation for coupling the upper rods for greater stability; a lower cradle formed with an upper surface and a lower surface and in a curved configuration the lower cradle having a lower surface coupled with respect to the upper ends of the upper bars and having an upper surface with a recess extending upwardly therefrom; an upper cradle having an upper surface and a lower surface in a curved configuration essentially concentric with the lower cradle, the central extent of the lower cradle coupled to the upper edge of the connector; and coupling components interconnecting the upper and lower cradles, the upper components including an elongated glide bar within the lower cradle and a slot extending along the upper surface of the lower cradle with a ball bearing assembly located therein, the coupling components also including a reciprocal glide bar secured to the lower extent of the spacer member and positioned upon the ball bearing to allow for axial movement thereof within the recess to reposition the upper cradle with respect to the lower cradle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved crutches with shiftable cradles which have all the advantages of the prior art crutches of a wide variety of designs and configurations and none of the disadvantages.

It is another object of the present invention to provide new and improved crutches with shiftable cradles which may be easily and efficiently manufactured and marketed.

It is further object of the present invention to provide new and improved crutches with shiftable cradles which are of durable and reliable constructions.

An even further object of the present invention is to provide new and improved crutches with shiftable cradles which are susceptible of a low cost of manufacture with regard to both materials and labor, and which accordingly are then susceptible of low prices of sale to the consuming public, thereby making such crutches with shiftable cradles economically available to the buying public.

Still yet another object of the present invention is to provide new and improved crutches with shiftable cradles which provide in the apparatuses and methods of the prior art some of the advantages thereof, while simultaneously overcoming some of the disadvantages normally associated therewith.

Still another object of the present invention is to maximize the comfort of people utilizing crutches by having the cradles shift forwardly and rearwardly for changing the area of the body receiving the maximum forces from the crutches.

Lastly, it is an object of the present invention to provide new and improved crutches with shiftable cradles comprising a lower rod positioned in a vertical orientation with an upper end and a lower end and a pair of radial apertures extending through the lower rod adjacent to its upper end; a pair of upper rods each with the rods being parallel with respect to each other from their upper ends to an area adjacent their lower ends with axial apertures therethrough with bolts and associated nuts extending through the apertures for the coupling thereof; a lower cradle formed with an upper surface and a lower surface and in a curved configuration the lower cradle having a lower surface coupled with respect to the upper ends of the upper bars and having an upper surface with a recess extending upwardly therefrom; an upper cradle having an upper surface and a lower surface in a curved configuration essentially concentric with the lower cradle, the central extent of the lower cradle coupled to the upper edge of the connector; and coupling components interconnecting the upper and lower cradles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
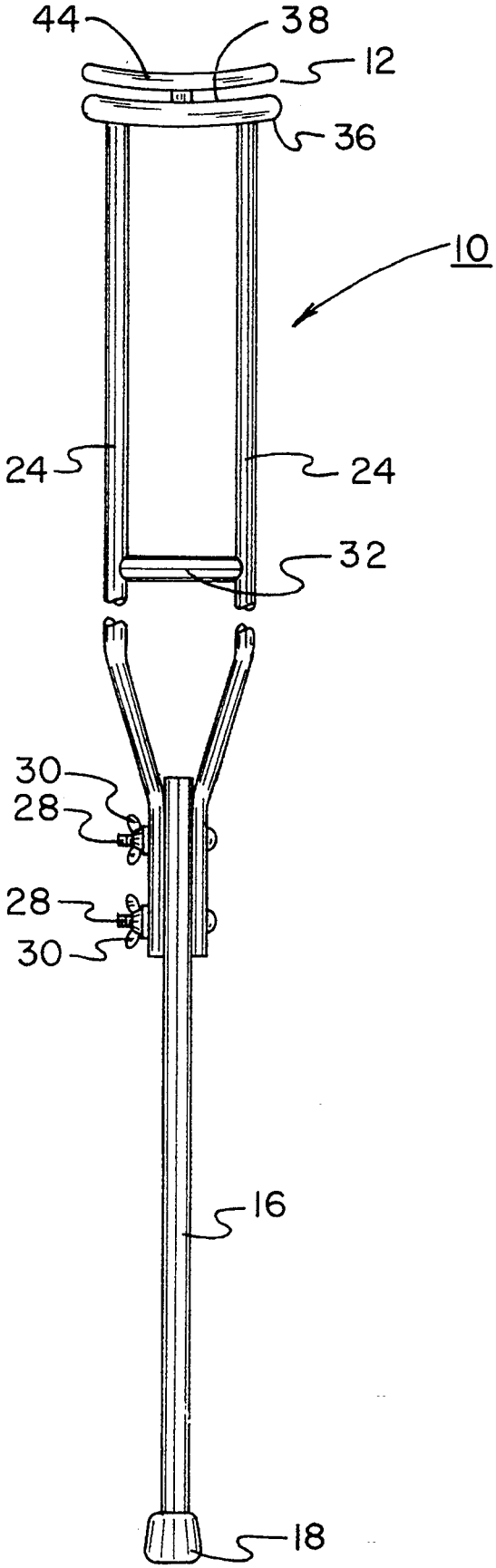
FIG. 1 is a side elevational view of the preferred embodiment of the new and improved crutches with shiftable cradles constructed in accordance with the principles of the present invention.
Figure 2:
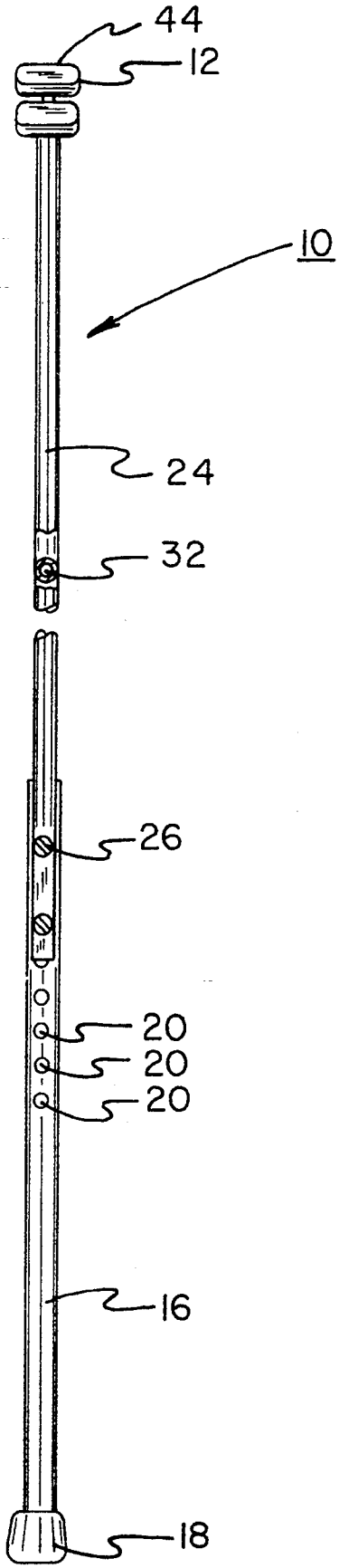
FIG. 2 is a front elevational view of the crutch shown in FIG. 1.
Figure 3:
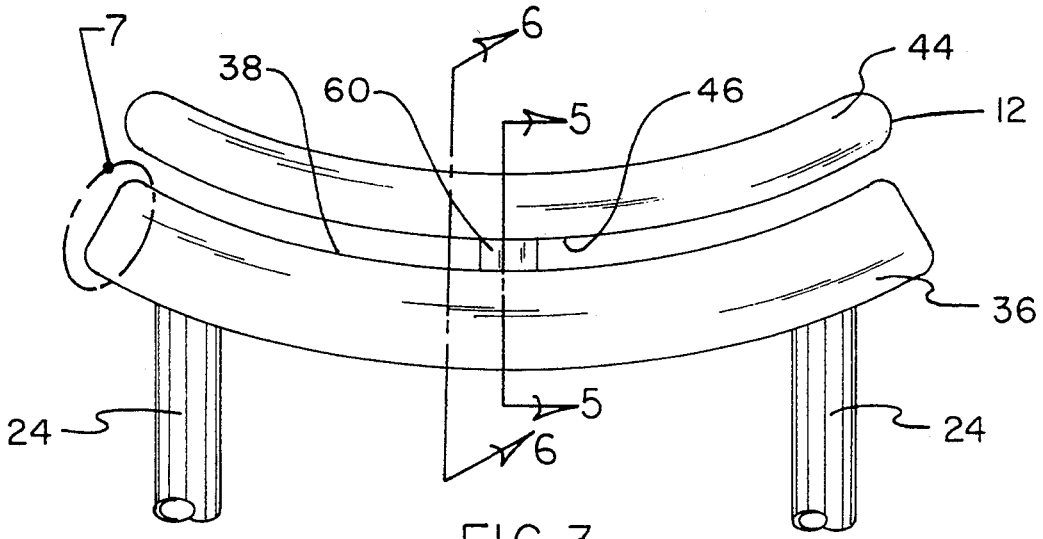
FIG. 3 is an enlarged side elevational view of the upper portion of the crutch of the prior Figure.
Figure 4:
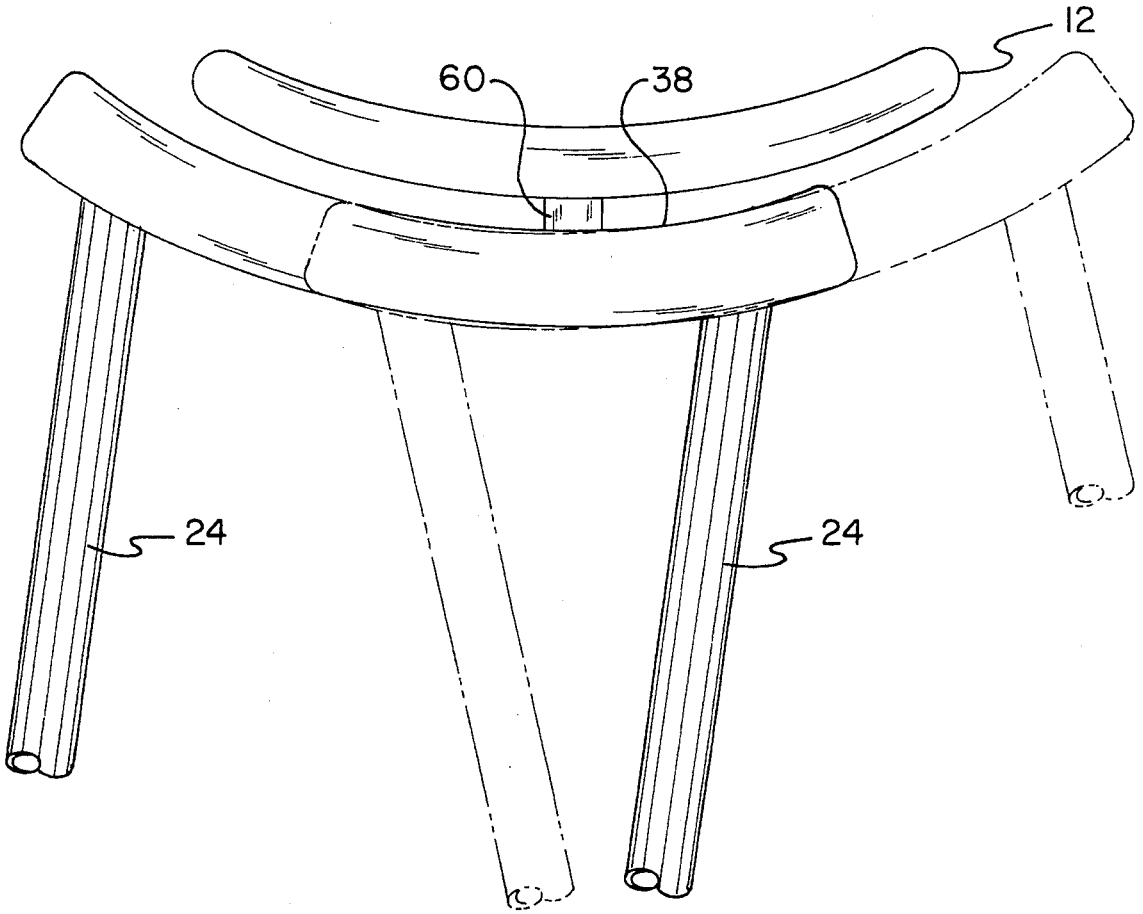
FIG. 4 is a view similar to FIG. 3 but illustrating the cradle shifted with respect to the lower cradle.
Figure 5:
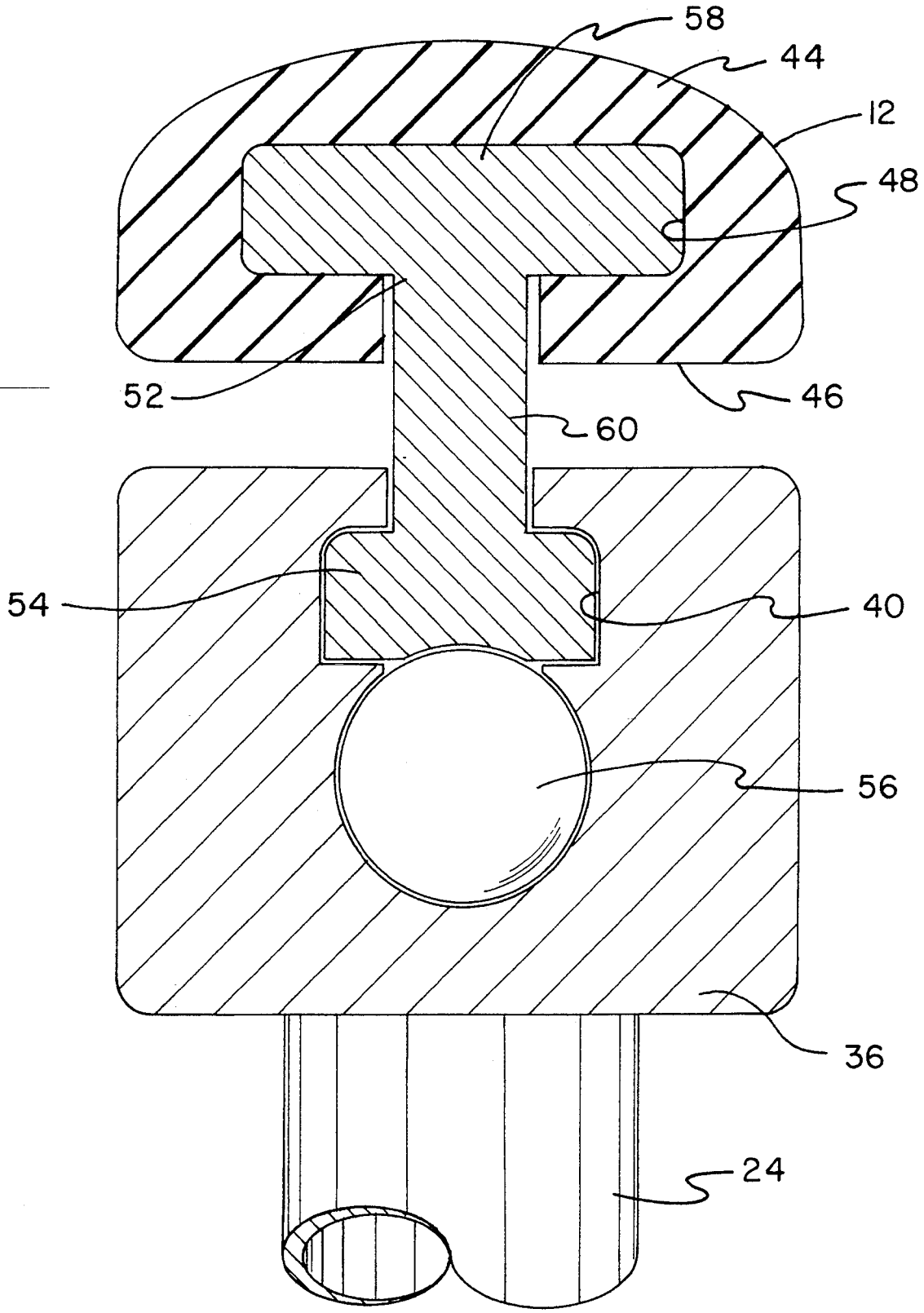
FIG. 5 is a cross-sectional view taken along line 5—5 of FIG. 3.
Figure 6:
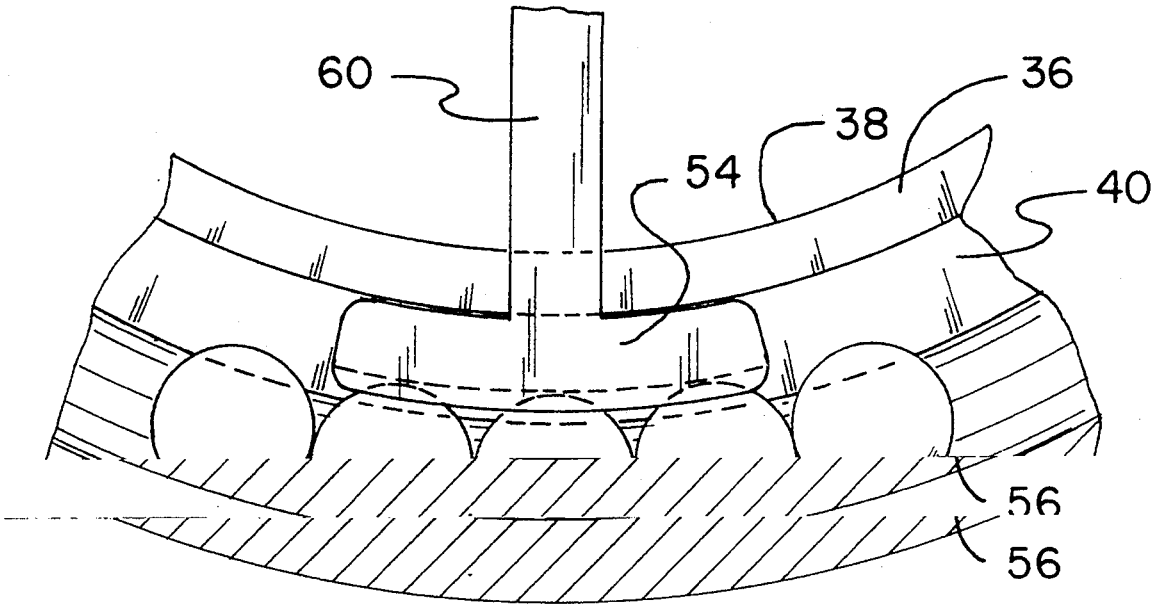
FIG. 6 is a cross-sectional view taken along line 6—6 of FIG. 3.
Figure 7:
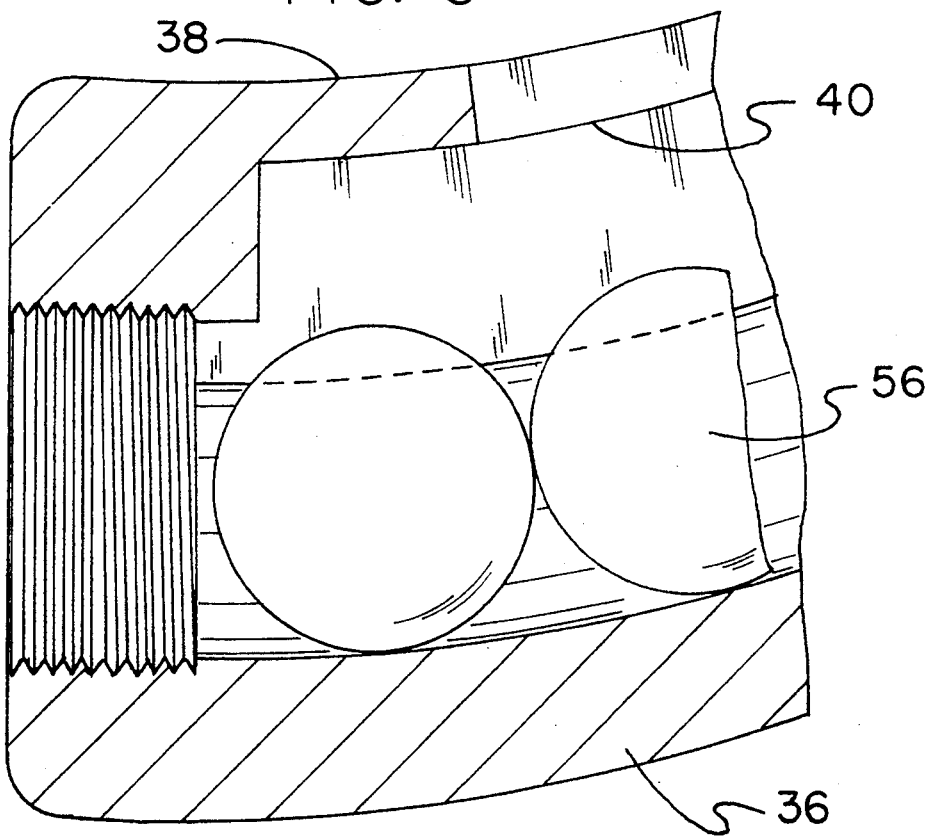
FIG. 7 is an enlarged view of the end of the lower cradle taken about circle 7 of FIG. 3.

With reference now to the drawings, and in particular to FIG. 1 thereof, the preferred embodiment of the new and improved crutches with shiftable cradles embodying the principles and concepts of the present invention and generally designated by the reference numeral 10 will be described.

The present invention, the new and improved crutches with shiftable cradles, is a system 10 in the form of a pair of crutches and comprised of a plurality of components. Such components, in their broadest context, include crutches, each with a lower rod and a pair of upper rods, a lower cradle, an upper cradle and coupling elements therebetween. Such components are individually configured and correlated with respect to each other so as to attain the desired objective.

The present invention, the new and improved crutches with shiftable cradles, is a system 10 in the form of a pair of crutches with shiftable cradles 12. The crutches 10 are of similar designs with each having a lower rod 16. The lower rod is positionable in a generally vertical orientation. Each has an upper end and a lower end. An elastomeric cover 18 covers the lower end of each lower rod. In addition, a pair of radial apertures 20 extend through the lower rod adjacent to its upper end.

The crutches also include a pair of upper rods 24. Each upper rod has an upper end and a lower end. The rods are parallel with respect to each other from their upper ends to an area adjacent to their lower ends. Adjacent to the lower ends, the upper rods are formed with angled sections where they angle inwardly. Such angled portions terminate at their lower end with axial apertures 26. Bolts 28 extend through the axial apertures of the upper and lower rods. Associated nuts 30 cooperate with the bolts which extend through the apertures for the coupling thereof. The nuts effect securement for adjustable positioning during operation and use. In addition, the upper rods having a lateral support 32 extending in a horizontal orientation. Such lateral support is for coupling the upper rods for greater stability.

Next provided is a lower cradle 36. The lower cradle is a member with an arcuate upper surface and concentric lower surface. These arcuate members are in a curved configuration. The lower surface is coupled with respect to the upper ends of the upper rods. The lower cradles each have an upper surface 38. Formed in there is a linear recess 40 which extends upwardly from an intermediate portion of the lower cradle. The upper extent of such recess is of a restricted size for retaining contents within the central portion of the recess.

Located above the lower recess is an upper cradle 44. The upper cradle has an upper surface and a lower surface 46. Both surfaces are curved in an arcuate manner essentially concentric with the curves of the lower cradle. The central extent of the lower cradle has an upwardly extending recess 48. Such recess is restricted at its lower extent and enlarged at its upper extent for retaining contents therein.

Located between the upper and lower cradles are coupling components 52. The coupling components interconnect the upper and lower cradles. The coupling components include an elongated glide bar 54. Such glide bar is a member curved concentric with the upper and lower surfaces of the lower cradle. It is located within the recess of the upper cradle for axial movement therealong. A slot is located above in the lower cradle above the recess with a coupling component 60 positioned therethrough for sliding movement of the glide bar along its axis. A ball bearing assembly 56 is located beneath the glide bar within the recess of the lower cradle to facilitate the ability of the glide bar to move axially within the recess as desired by the user. Coupled to the upper extent of the coupling member is an upper bar 58 similar in configuration to the glide bar. Such upper member is located within the upper cradle secured in position by the recess. The relationship of the upper bar, glide bar and coupler therebetween within the recesses of the upper and lower cradle allow relative shifting motion of the upper cradle with respect to the lower cradle to aid in the comfort and facility of the user of the crutches provided with the system of the present invention.

The present invention is very light in weight and much more comfortable to use because it does not irritate the armpits. Since they support a great deal of the patient's weight, the armpits often become inflamed very quickly after the crutches are put into use.

These crutches are made of fiberglass or aluminum, in the usual configurations. However, the ordinary curved cradles which fit under the armpits are replaced by cradles which are mounted on roller bearings. This is done because of the very unusual loads which are imposed on the armpits. They are never required to be in such contact with objects, so the skin in that area is very delicate. Therefore it is logical that special measures should be taken to permit the armpits to sustain these loads without being irritated.

The cradle is made in two sections so they can serve as the races for a double row of roller bearings. Since roller bearings are in the class of very low friction supports, the armpit cradle moves effortlessly under the stresses of the weight imposed on them.

The bearings are very lightly lubricated to improve the friction characteristics, using a compound which will not soil clothing and garments. Heat treated alloy steels may be used in the bearings as well as the race surfaces, to obtain the best wear and performance properties.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crutch with shiftable cradles comprising, in combination:

a lower rod positioned in a vertical orientation with an upper end and a lower end and an elastomeric cover over the lower end and a pair of radial apertures extending through the lower rod adjacent to its upper end;

a pair of upper rods each having upper ends and lower ends, with the rofs being parallel with respect to each other from their upper ends to an area adjacent their lower ends and with the lower ends being angled inwardly and formed with axial apertures therethrough, fasteners extending through the apertures to couple the lower ends thereof, the upper rods having a lateral support extending in a horizontal orientation for coupling the upper rods together for greater stability;

a lower cradle formed with an upper surface and a lower surface and in a curved configuration, said lower surface coupled to the upper ends of the upper bars, a recess formed along said upper surface and extending upwardly therefrom;

an upper cradle having an upper surface and a lower surface in a curved configuration essentially concentric with the lower cradle;

a coupling component interconnecting the upper and lower cradles; said coupling component including an elongated upper glide bar, a spacer member and a second glide bar; said upper glide bar is coupled to a central extent of said upper cradle; said second glide bar is secured to a lower end of said spacer member and is positioned within said lower cradle; a ball bearing assembly located in said recess, wherein said second glide bar being positioned upon said ball bearing assembly to allow for axial movement thereof within the recess to reposition the upper cradle with respect to the lower cradle.

2. Crutches with shiftable cradles comprising:

a lower rod positioned in a vertical orientation with an upper end and a lower end and a pair of radial apertures extending through the lower rod adjacent to its upper end;

a pair of upper rods each with the rods being parallel with respect to each other from their upper ends to an area adjacent their lower ends with axial apertures therethrough with bolts and associated nuts extending through the apertures for the coupling thereof;

a lower cradle formed with an upper surface and a lower surface and in a curved configuration said lower surface coupled to the upper ends of the upper bars, said upper surface having a recess extending upwardly therefrom;

an upper cradle having an upper surface and a lower surface in a curved configuration essentially concentric with the lower cradle; and coupling component interconnecting the upper and lower cradles wherein an upper edge of said coupling component being coupled to an central extent of said upper cradle such that said upper cradle is slidable along the upper surface of the lower cradle.

3. Crutches as set forth in claim 2 wherein said coupling component includes a spacer member, upper and lower glide bars each secured to an end of the spacer member; wherein said upper glide bar is positioned within the upper cradle, said lower glide bar is positioned within the lower cradle; a ball bearing assembly located in the recess on the upper surface of the lower cradle, wherein said lower glide bar is positioned upon the ball bearing assembly to allow for axial movement thereof within said recess.

* * * * *